US006351969B1

(12) United States Patent
Arman et al.

(10) Patent No.: US 6,351,969 B1
(45) Date of Patent: Mar. 5, 2002

(54) CRYOGENIC NITROGEN PRODUCTION SYSTEM USING A SINGLE BRAZEMENT

(75) Inventors: Bayram Arman; Dante Patrick Bonaquist, both of Grand Island, NY (US); Tu Cam Nguyen, Falcon Heights, MN (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/774,029

(22) Filed: Jan. 31, 2001

(51) Int. Cl.[7] ..... F25J 1/00
(52) U.S. Cl. ..... 62/643; 62/903
(58) Field of Search ..... 62/643, 903

(56) References Cited

U.S. PATENT DOCUMENTS 4,208,198 A * 6/1980 Small ..... 62/903
4,345,925 A 8/1982 Cheung ..... 62/13
4,579,566 A * 4/1986 Brugerolle ..... 62/643
5,144,809 A 9/1992 Chevalier et al. ..... 62/36
5,275,004 A 1/1994 Agrawal et al. ..... 62/24
5,303,556 A 4/1994 Dray et al. ..... 62/24
5,410,885 A 5/1995 Smolarek et al. ..... 62/25
5,461,870 A * 10/1995 Paradowski ..... 62/903
5,592,832 A 1/1997 Herron et al. ..... 62/646
5,596,883 A 1/1997 Bernhard et al. ..... 62/618
5,694,790 A 12/1997 Lavin ..... 62/640

* cited by examiner

*Primary Examiner*—Ronald Capossela
(74) *Attorney, Agent, or Firm*—Stanley Ktorides

(57) ABSTRACT

A cryogenic nitrogen production plant wherein all the heat transfer steps, and preferably all the heat transfer and separation steps, are carried out in a brazement which receives feed air and from which is recovered product nitrogen.

10 Claims, 3 Drawing Sheets

CRYOGENIC NITROGEN PRODUCTION SYSTEM USING A SINGLE BRAZEMENT

TECHNICAL FIELD

This invention relates generally to the cryogenic separation of feed air for the production of nitrogen and, more particularly, to an improved plant for the production of same.

BACKGROUND ART

In the production of nitrogen by the cryogenic rectification of feed air, the feed air, after being pressurized and cleaned of high boiling impurities, undergoes cooling to the proper temperature prior to being introduced into a cryogenic rectification column. Fluids from the column undergo one or more subcooling, condensation, vaporization and heating steps, and the product nitrogen is heated prior to recovery. These separation and heat exchange operations require the use of an extensive piping network as fluids are passed from one piece of equipment to another in order to carry out these operations. Such a network is complicated, expensive to construct, and inefficient to operate. A cryogenic nitrogen production plant which reduces the complexity of heretofore necessary piping networks would be highly desirable.

Accordingly, it is an object of this invention to provide a cryogenic nitrogen production plant which for comparable production capability is less complex than heretofore available cryogenic nitrogen production plants.

SUMMARY OF THE INVENTION

The above and other objects, which will become apparent to one skilled in the art upon a reading of this disclosure, are attained by the present invention, one aspect of which is:

Apparatus for producing product nitrogen by the cryogenic separation of feed air comprising:

(A) a brazement containing a heat exchange section, a condenser, and a separation section;

(B) means for passing feed air from outside the brazement into the heat exchange section, and means for passing feed air from the heat exchange section to the separation section;

(C) means for passing waste fluid from the separation section to the condenser, means for passing waste fluid from the condenser to the heat exchange section, and means for passing waste fluid from the heat exchange section to outside the brazement; and (D) means for passing product nitrogen from the separation section to the heat exchange section, and means for passing product nitrogen from the heat exchange section to outside the brazement for recovery.

Another aspect of the invention is:

Apparatus for producing product nitrogen by the cryogenic separation of feed air comprising:

(A) a brazement containing a heat exchange section and a condenser, and a separation section outside of the brazement;

(B) means for passing feed air from outside the brazement into the heat exchange section, and means for passing feed air from the heat exchange section to the separation section;

(C) means for passing waste fluid from the separation section to the condenser, means for passing waste fluid from the condenser to the heat exchange section, and means for passing waste fluid from the heat exchange section to outside the brazement; and (D) means for passing product nitrogen from the separation section to the heat exchange section, and means for passing product nitrogen from the heat exchange section to outside the brazement for recovery.

As used herein, the term "feed air" means a mixture comprising primarily nitrogen and oxygen, such as ambient air.

As used herein, the term "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are counter currently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Cryogenic rectification is a rectification process carried out at least in part at temperatures at or below 150 degrees Kelvin.

As used herein, the term "indirect heat exchange" means the bringing of two fluids into heat exchange relation without any physical contact or intermixing of the fluids with each other.

As used herein the term "subcool" means to cool a liquid to be at a temperature lower than the saturation temperature of that liquid for the existing pressure.

As used herein, the term "phase separator" means a vessel wherein incoming feed is separated into individual vapor and liquid fractions. Typically, the vessel has sufficient cross-sectional area so that the vapor and liquid are separated by gravity.

As used herein, the term "product nitrogen" means a fluid having a nitrogen concentration of at least 90 mole percent.

As used herein, the term "waste fluid" means a fluid having a nitrogen concentration which is less than the nitrogen concentration of the product nitrogen produced using the invention.

As used herein, the term "brazement" means a structure for carrying out heat and/or mass transfer processes having a complex internal arrangement and being put together by brazing, soldering, welding and/or flange connections.

As used herein, the term "condenser" means a device which generates reflux for use in cryogenic rectification.

As used herein, the term "reflux condenser" means a structure that enables simultaneous heat and mass transfer while condensing a vapor.

DETAILED DESCRIPTION

Figure 1:
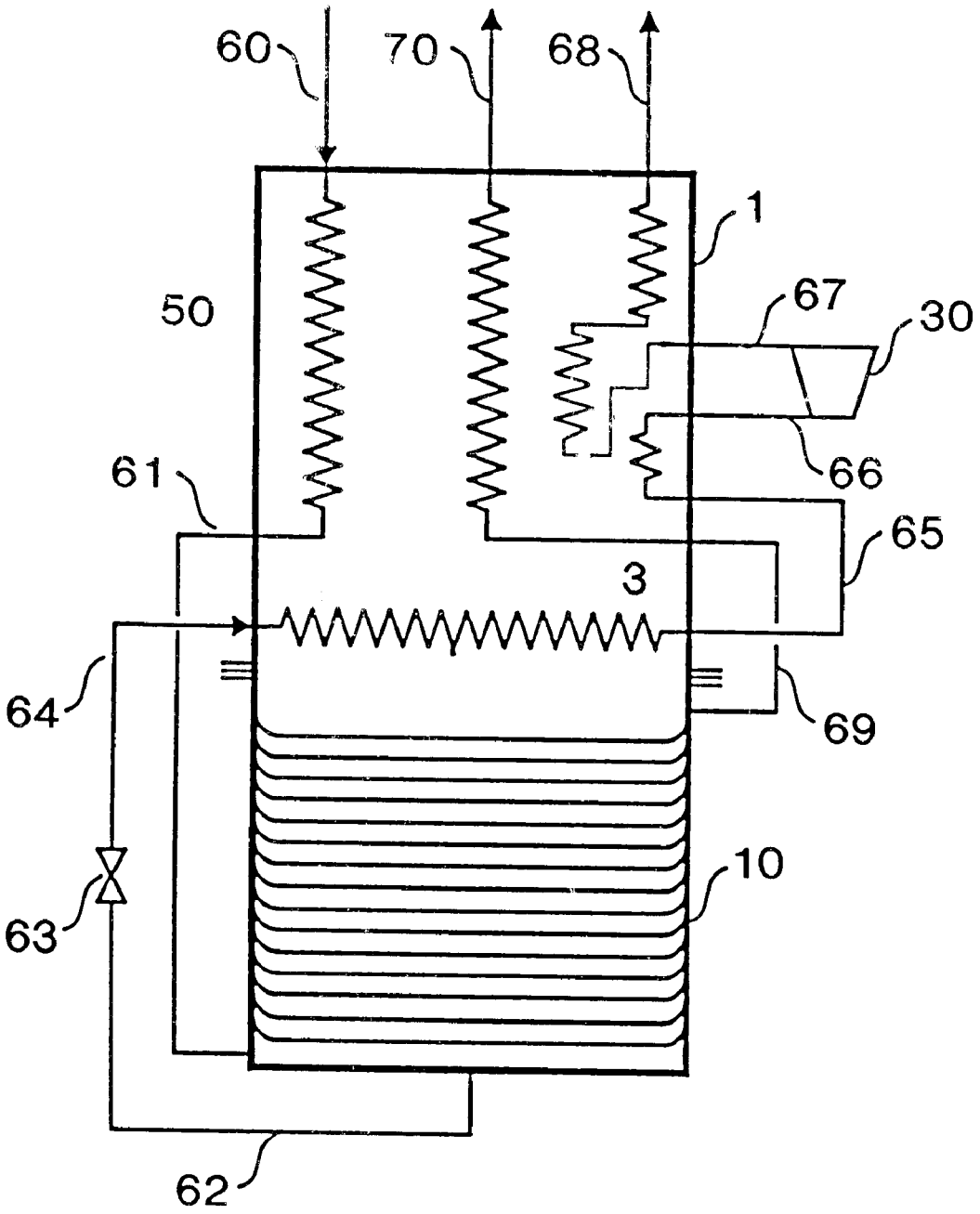
FIG. 1 is a schematic representation of one preferred embodiment of the nitrogen production facility of the invention.

The invention will be described in detail with reference to the Drawings. Referring now to FIG. 1, brazement 50 contain heat exchange section 1 condenser 3, and separation section 10. Feed air 60, which has been cleaned of high boiling impurities, is cooled to near saturation temperature by indirect heat exchange in heat exchange section 1 with return streams, and the resulting cooled feed is passed in line 61 to separation section 10. Within separation section 10 the feed air is separated by cryogenic rectification into product nitrogen and waste fluid. Waste fluid is passed in line 62 from separation section 10 through valve 63 and as stream 64 to condenser 3 wherein it is vaporized thereby serving to condense a portion of the product nitrogen rising from the separation section. The condensed product nitrogen falls back from condenser 3 into the separation section to serve as reflux for the cryogenic rectification.

A portion of the product nitrogen Vapor rising from the separation section is passed from separation section 10 in line 69 to heat exchange section 1 wherein it is warmed and from which it is passed out of brazement 50 in line 70 for recovery as product nitrogen. Waste fluid from condenser 3 is passed in line 65 to heat exchange section 1 wherein it is warmed to an intermediate temperature. It is then passed as stream 66 to turboexpander 30 wherein it is turboexpanded to generate refrigeration. Resulting refrigeration bearing stream 67 is passed back to heat exchange section 1 wherein it is warmed. The warmed waste fluid stream is then passed out of brazement 50 in line 68.

In the practice of this invention, all of the heat transfer steps associated with the system, including heating, cooling, condensation, vaporization and subcooling steps, take place within the brazement. The only heat transfer steps that take place outside the brazement are extraprocess heat transfer steps such as cooling of compressor discharge to remove heat of compression.

Figure 2:
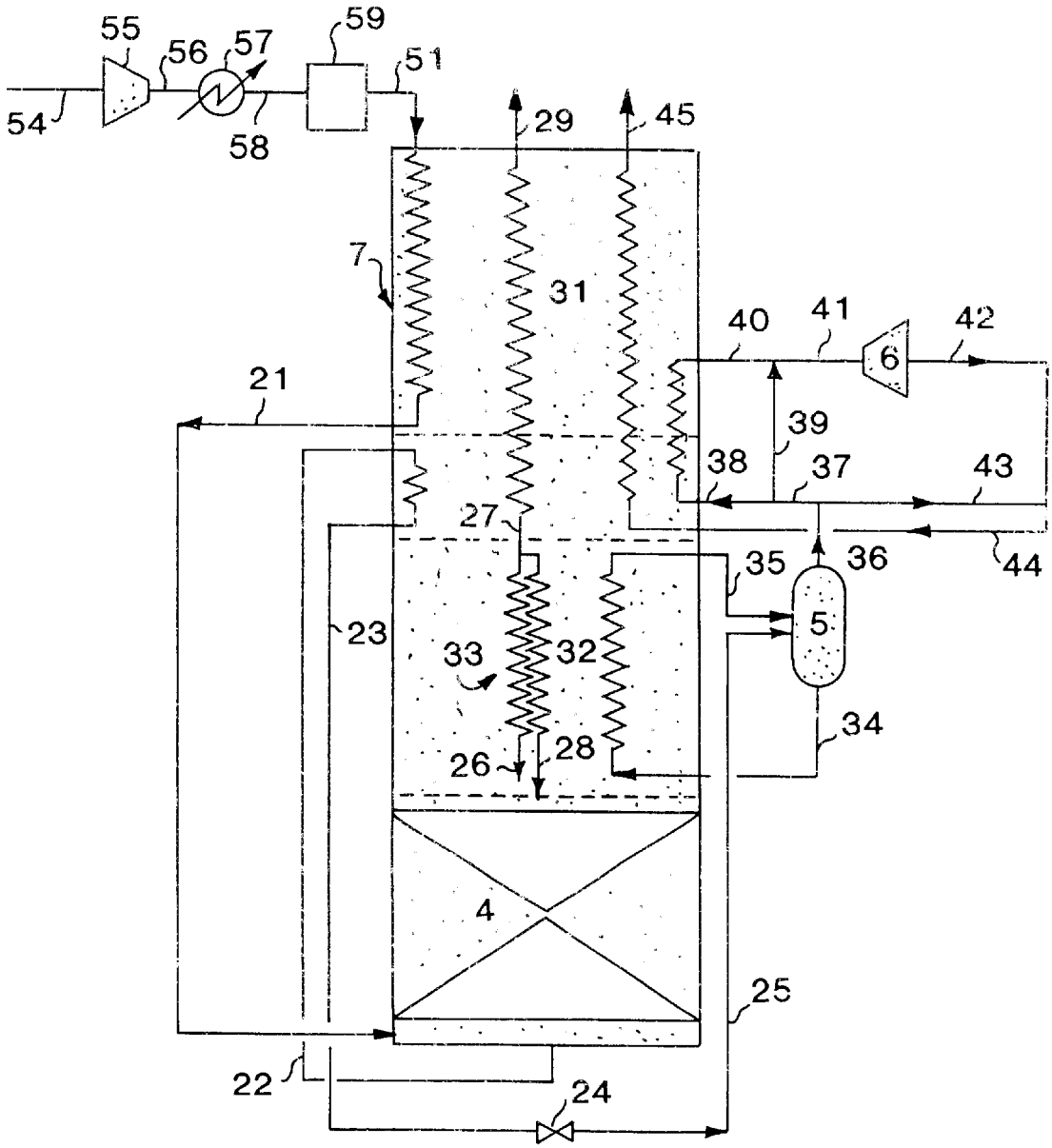
FIG. 2 is a schematic representation of another preferred embodiment of the nitrogen production facility of the invention employing a reflux condenser.

FIG. 2 illustrates another embodiment of the invention wherein the condenser includes a reflux condenser. Referring now to FIG. 2, brazement 7 contain heat exchange section 31, condenser 32, and separation section 4. Feed air 54 is compressed to a pressure generally within the range of from 50 to 250 pounds per square inch absolute (psia) by passage through compressor 55. Compressed feed air 56 is cooled of the heat of compression by passage through cooler 57 and resulting feed air 58 is passed to purifier 59 wherein it is cleaned of high boiling impurities such as water vapor, carbon dioxide and hydrocarbons.

Cleaned, compressed feed air 51 is passed into brazement 7 and is cooled in heat exchange section 31 by indirect heat exchange with return streams. The cooled feed air is then passed in line 21 to separation section 4 wherein it is separated by cryogenic rectification into product nitrogen and into waste fluid. Waste fluid is passed in line 22 from separation section 4 to heat exchange section 31 wherein it is subcooled and from there is passed in line 23 to valve 24 and from there in line 25 to phase separator 5. Liquid waste fluid is passed from phase separator 5 in line 34 to condenser 32 wherein it is at least partially vaporized by indirect heat exchange with product nitrogen which is passing through reflux condenser portion 33 of condenser 32. The resulting waste fluid from condenser 32 is passed back into phase separator 5 using line 35.

Product nitrogen vapor passes out from separation section 4 in line 26 in reflux condenser 33 and is partially condensed as it rises. The liquid portion of the resulting product nitrogen is passed back down reflux condenser 33 and returned in line 28 to separation section 4 wherein it serves as reflux for the cryogenic rectification. The remaining vapor portion of the product nitrogen is passed in line 27 to heat exchange section 31 wherein it is warmed. It is then removed from brazement 7 in line 29 for recovery as product nitrogen.

Waste fluid vapor is passed out of phase separator 5 in stream 36 and divided into portion 37 and portion 43. Portion 37 is further divided into part 38 which is warmed by partial traverse of heat exchange section 31 to form stream 40, and into part 39 which bypasses heat exchange section 31 and unites with stream 40 to form combined stream 41. The partial traverse of the heat exchange section may include countercurrent flow, cocurrent flow, and/or crossflow. Stream 41 is turboexpanded by passage through turboexpander 6 to form refrigeration bearing stream 42 which is then combined with portion 43 to form waste fluid stream 44. Stream 44 is then warmed by passage through heat exchange section 31 and is withdrawn from brazement 7 as waste fluid stream 45.

Figure 3:
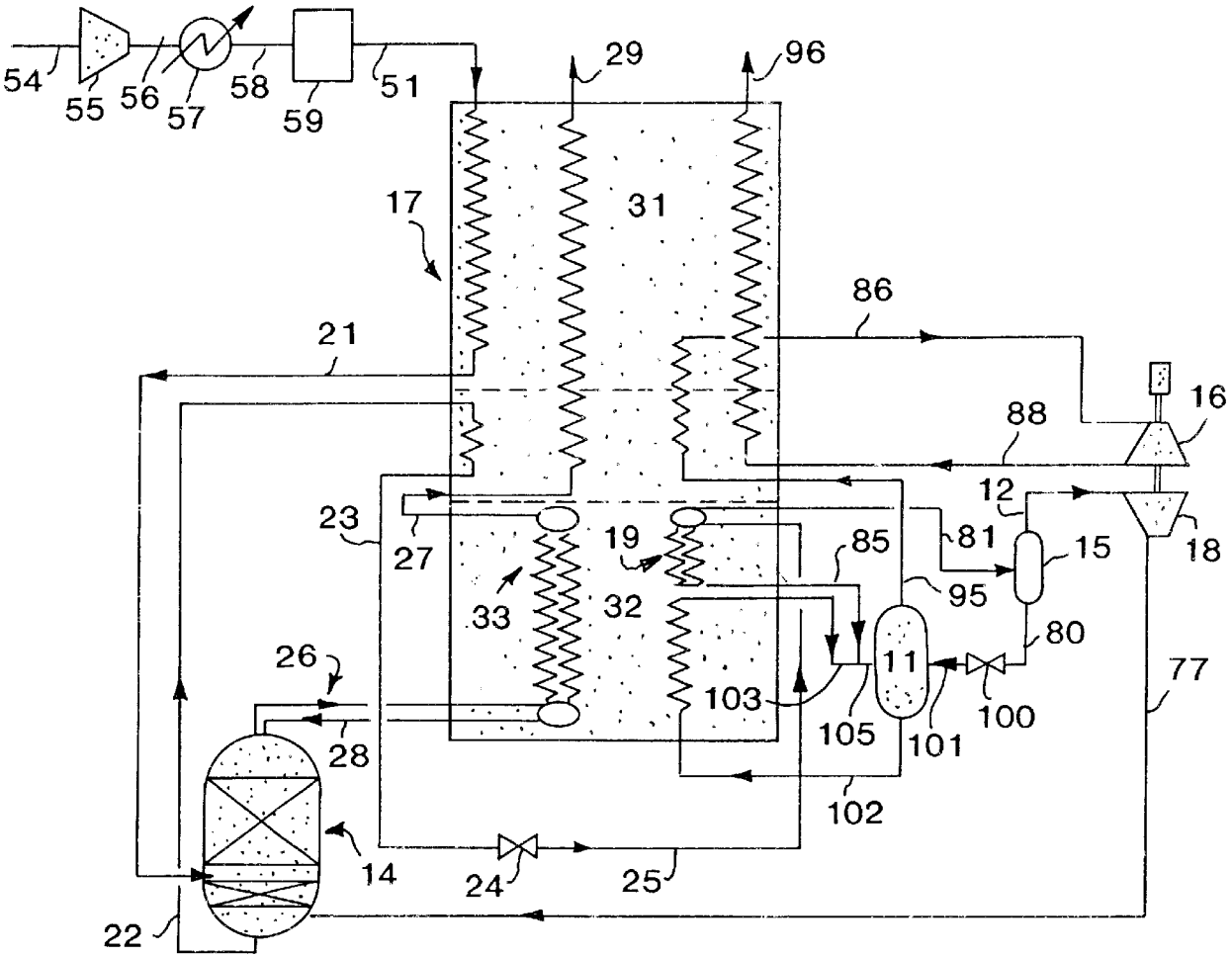
FIG. 3 is a schematic representation of another preferred embodiment of the nitrogen production facility of the invention wherein the separation section is outside the brazement.

FIG. 3 illustrates another embodiment of the invention wherein the separation section is outside of the brazement. The numerals in FIG. 3 are the same as those of FIG. 2 for the common elements, and these common elements will not be described again in detail.

Referring now to FIG. 3, brazement 17 contains heat exchange section 31 and condenser 32. The separation section, in the form of column 14, is outside brazement 17. The feed air from heat exchange section 31 is passed in stream 21 to column 14 and is separated therein by cryogenic rectification into product nitrogen, which is then processed as previously described, and into waste fluid.

Waste fluid in stream 25 is passed to module 19 of condenser 32 wherein it is partially vaporized with a portion passed in stream 81 to phase separator 15 and a portion passed in stream 85 to phase separator 11. Vapor from phase separator 15 is passed in stream 12 to compressor 18 wherein it is compressed to a pressure generally within the range of from 60 to 250 psia, and resulting pressurized waste fluid is passed in stream 77 from compressor 18 to column 14 to serve as vapor upflow for the cryogenic rectification. Liquid from phase separator 15 is passed in stream 86 through valve 100 and as stream 101 into phase separator 11.

Liquid from phase separator 11 is passed in line 102 to condenser 32 wherein it is at least partially vaporized and from there passed in stream 103 into phase separator 11. As shown in FIG. 3, stream 103 may be combined with aforesaid stream 85 to form stream, 105 for passage into phase separator 11. Waste fluid vapor from phase separator 11 is passed in line 95 to heat exchange section 31 wherein it is warmed to an intermediate temperature and then passed in stream 86 to turboexpander 16 wherein it is turboexpanded. In the embodiment of the invention illustrated in FIG. 3, turboexpander 16 is coupled to compressor 18 thus serving to drive compressor 18. Refrigeration bearing waste fluid stream 88 is passed from turboexpander 16 to heat exchange section 31 wherein it is warmed. The warmed waste fluid is then passed out of brazement 17 it in line 96.

Although the invention has been discussed in detail with reference to certain preferred embodiments, those skilled in the art will recognize that there are other embodiments of the invention within the spirit and the scope of the claims.

What is claimed is:

1. Apparatus for producing product nitrogen by the cryogenic separation of feed air comprising:

(A) a brazement containing a heat exchange section, a condenser, and a separation section;

(B) means for passing feed air from outside the brazement into the heat exchange section, and means for passing feed air from the heat exchange section to the separation section;

(C) means for passing waste fluid from the separation section to the condenser, means for passing waste fluid from the condenser to the heat exchange section, and means for passing waste fluid from the heat exchange section to outside the brazement; and (D) means for passing product nitrogen from the separation section to the heat exchange section, and means for passing product nitrogen from the heat exchange section to outside the brazement for recovery.

2. The apparatus of claim 1 wherein the means for passing product nitrogen from the separation section to the heat exchange section includes a reflux condenser.

3. The apparatus of claim 1 wherein the means for passing waste fluid from the separation section to the condenser includes a partial traverse of the heat exchange section.

4. The apparatus of claim 1 wherein the means for passing waste fluid from the condenser to the heat exchange section includes a turboexpander.

5. The apparatus of claim 1 wherein the means for passing waste fluid from the separation section to the condenser includes a phase separator.

6. The apparatus of claim 1 wherein the means for passing waste fluid from the separation section to the condenser includes a phase separator.

7. Apparatus for producing product nitrogen by the cryogenic separation of feed air comprising:

(A) a brazement containing a heat exchange section and a condenser, and a separation section outside of the brazement;

(B) means for passing feed air from outside the brazement into the heat exchange section, and means for passing feed air from the heat exchange section to the separation section;

(C) means for passing waste fluid from the separation section to the condenser, means for passing waste fluid from the condenser to the heat exchange section, and means for passing waste fluid from the heat exchange section to outside the brazement; and (D) means for passing product nitrogen from the separation section to the heat exchange section, and means for passing product nitrogen from the heat exchange section to outside the brazement for recovery.

8. The apparatus of claim 7 wherein the means for passing product nitrogen from the separation section to the heat exchange section includes a reflux condenser.

9. The apparatus of claim 7 wherein the means for passing waste fluid from the separation section to the condenser includes a partial traverse of the heat exchange section.

10. The apparatus of claim 7 wherein the means for passing waste fluid from the condenser to the heat exchange section includes a turboexpander.

* * * * *